US011026483B2

(12) United States Patent
Alley

(10) Patent No.: US 11,026,483 B2
(45) Date of Patent: Jun. 8, 2021

(54) STRETCH FASTENER

(71) Applicant: Randall Alley, Westlake Village, CA (US)

(72) Inventor: Randall Alley, Westlake Village, CA (US)

(73) Assignee: Randall Alley, Westlake Village, CA (US)

( * ) Notice: Subject to any disclaimer, the term of this patent is extended or adjusted under 35 U.S.C. 154(b) by 0 days.

(21) Appl. No.: 16/500,780

(22) PCT Filed: Apr. 4, 2018

(86) PCT No.: PCT/US2018/026132
§ 371 (c)(1),
(2) Date: Oct. 3, 2019

(87) PCT Pub. No.: WO2018/187504
PCT Pub. Date: Oct. 11, 2018

(65) Prior Publication Data

US 2020/0107616 A1 Apr. 9, 2020

Related U.S. Application Data

(60) Provisional application No. 62/535,774, filed on Jul. 21, 2017, provisional application No. 62/481,605, filed on Apr. 4, 2017.

(51) Int. Cl.
*A44B 11/25* (2006.01)
*A44B 11/26* (2006.01)

(52) U.S. Cl.
CPC ..... *A44B 11/2576* (2013.01); *A44B 11/266* (2013.01)

(58) Field of Classification Search
CPC ..... A44B 11/2576; A44B 11/266
See application file for complete search history.

(56) References Cited

U.S. PATENT DOCUMENTS 4,961,251 A 10/1990 Smith
6,393,671 B1 5/2002 Chen
(Continued)

FOREIGN PATENT DOCUMENTS

FR 1152900 2/1958
KR 20-1999-0033746 8/1999
(Continued)

OTHER PUBLICATIONS

PCT Search Report & Written Opinion for PCT/US2018026132 entitled Stretch Fastener filed Apr. 4, 2018 by Randall Alley (13 pages).

(Continued)

*Primary Examiner* — Victor D Batson
*Assistant Examiner* — Matthew J Sullivan
(74) *Attorney, Agent, or Firm* — Fish IP Law, LLP

(57) ABSTRACT

A fastener having two strap ends connected by an elastomeric member is described. The elastomeric member has sufficient elasticity to allow a user to increase the distance of separation between the two strap ends by applying a tension force, while providing enough tension to return the two strap ends to close proximity when the user releases the tension force. The elastomeric member may also have an adjustable elasticity to accommodate different applications with different load forces.

18 Claims, 8 Drawing Sheets

(56) References Cited

U.S. PATENT DOCUMENTS

| | | | | |
|---|---|---|---|---|
| 6,463,637 | B1 | 10/2002 | Carnahan | |
| D726,841 | S * | 4/2015 | Wright | D21/662 |
| 9,308,411 | B2 * | 4/2016 | Friedberg | A63B 21/00043 |
| 9,848,688 | B2 * | 12/2017 | Davis | B25H 3/00 |
| 2007/0062012 | A1 | 3/2007 | Caison | |
| 2011/0224055 | A1 * | 9/2011 | Kassel | A63B 21/4019 482/121 |
| 2012/0258844 | A1 * | 10/2012 | Petrone | A63B 21/00061 482/124 |
| 2013/0263473 | A1 | 10/2013 | Young | |
| 2016/0143397 | A1 | 5/2016 | Alvarez | |
| 2016/0374432 | A1 | 12/2016 | Park | |

FOREIGN PATENT DOCUMENTS

| | | |
|---|---|---|
| KR | 10-2009-0025522 | 3/2009 |
| KR | 10-2009-009860 | 8/2009 |

OTHER PUBLICATIONS

Extended European Search Report for Application No. EP18781507.1, dated Jul. 10, 2020, 8 pages.

* cited by examiner

STRETCH FASTENER

FIELD OF THE INVENTION

The field of the invention is fasteners, more particularly, devices and methods for facilitating the reengagement of mating connectors and the auto-return of strap ends.

BACKGROUND

The background description includes information that may be useful in understanding the present invention. It is not an admission that any of the information provided herein is prior art or relevant to the presently claimed invention, or that any publication specifically or implicitly referenced is prior art.

Various configurations of fasteners having connectors with releasable engagements are known. Unfortunately, the current state of the art in fasteners fails to provide an auto-return and/or re-engagement of the connectors once they are disconnected. The user must realign each connector to re-engage. It would be advantageous to provide a fastener that re-aligns or maintains alignment of the connectors while they are disengaged. It would also be advantageous to provide a fastener that auto-returns the connectors back to proximity and, in some applications, re-engagement.

U.S. Pat. No. 6,393,671 describes an elastic belt buckle with a prong that fastens to the base of the buckle at a flexible position, thereby allowing the belt to expand when worn by a user. While advantageous in some aspects, such as by providing more comfort when the user is moving (e.g., crouching, dancing, etc.) the buckle does not provide any auto-return or re-engagement feature once the prong is disengaged from the base of the buckle.

U.S. Pat. No. 4,961,251 describes a safety belt buckle with a flexible guard that wraps around the buckle and prevents depression and disengagement. However, the guard does not provide an auto-return feature and does not allow for the connectors to be separated by a distance with the guard in place.

U.S. Pat. No. 6,463,637 describes a movable cover and protector for a belt buckle. The cover is designed to prevent accidental release of the buckle, especially for law enforcement that may engage in hand to hand combat. However, the cover does not provide an auto-return feature and must be moved away to disengage the buckle.

These and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

Thus, there is still a need for an improved fastener that facilitates reengagement of connectors.

SUMMARY OF THE INVENTION

The inventive subject matter provides apparatus, systems and methods in which a fastener has a first strap end and a second strap end that are coupled with an elastomeric member. The elastomeric member has sufficient elasticity to allow a user to separate the two strap ends by applying a separation force (e.g., pulling the strap ends apart), while still providing enough tension to return the two strap ends to close proximity when the user removes the separation force (e.g., releases the straps). The elastomeric member may also have an adjustable elasticity so that the fastener can be adjusted for different applications that may require different loads or separation distances.

In one aspect of some embodiments, the fastener also includes two engaging connectors, one coupled to each strap end. The engaging connectors can comprise a male connector with flexible prongs that engage or mate with a female connector. The engaging connectors could also comprise a latching mechanism, a hook and loop engagement, or a magnetic coupling. It is further contemplated that any connector suitable for releasably engaging two ends can be used in a manner consistent with the inventive subject matter disclosed herein.

Various objects, features, aspects and advantages of the inventive subject matter will become more apparent from the following detailed description of preferred embodiments, along with the accompanying drawing figures in which like numerals represent like components.

DETAILED DESCRIPTION

Figure 1:
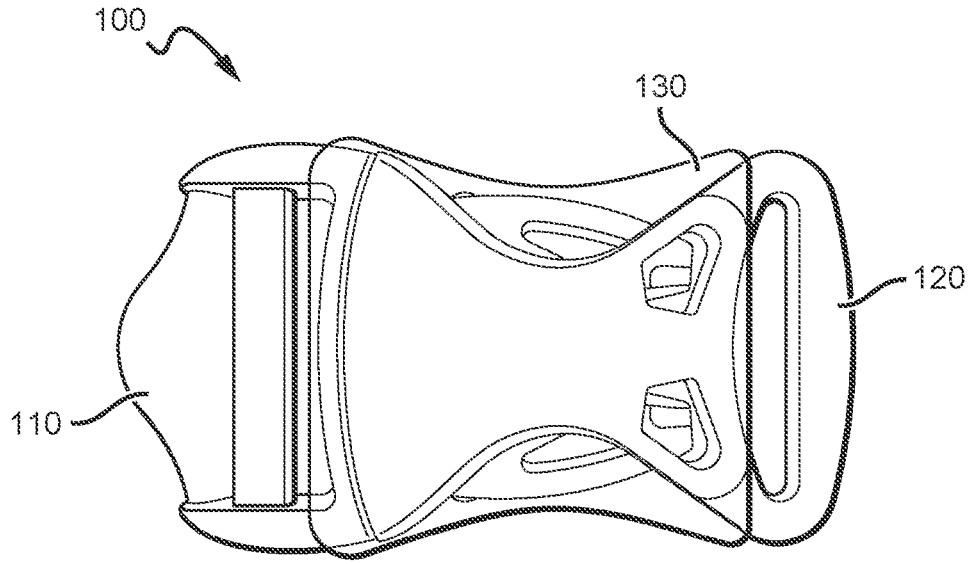
FIG. 1 is a front view of one embodiment of a stretch fastener comprising two connectors in an engaged configuration and disposed in an elastomeric member.
Figure 2:
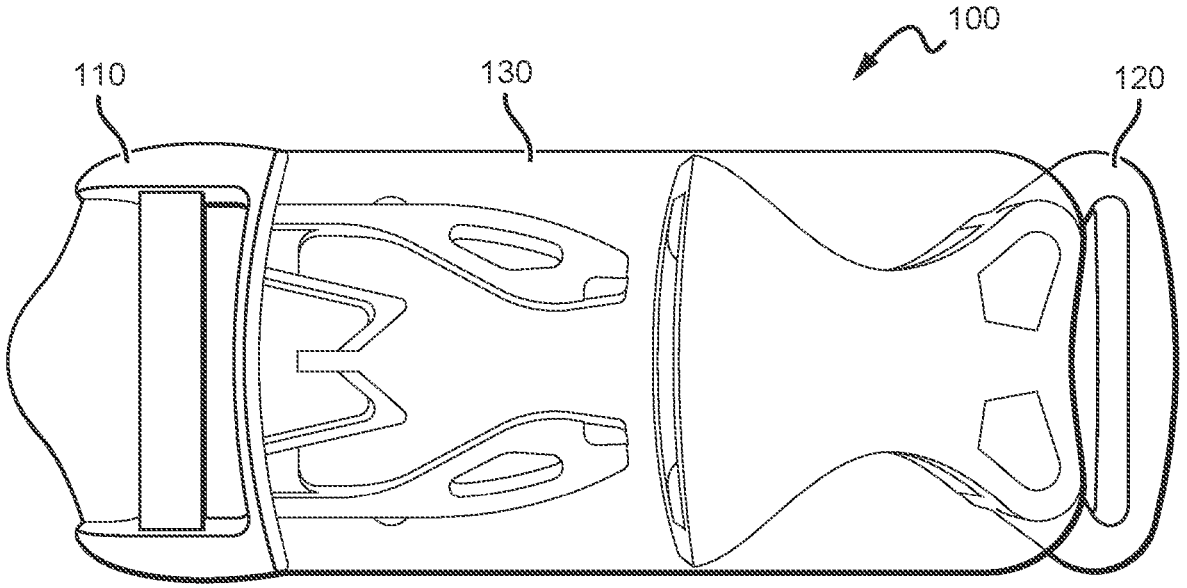
FIG. 2 is a front view of the fastener of FIG. 1 with the connectors in a disengaged configuration.

FIG. 1 shows a stretch fastener 100 in an engaged configuration. Fastener 100 comprises a male connector 110, a female connector 120, and an elastomeric member 130. Male connector 110 has two flexible prongs that mate with catches on the female connector 120 in a latched or engaged configuration. Elastomeric member 130 is sufficiently flexible such that a user can squeeze the prongs when male connector 110 is inside elastomeric member 130, to push the prongs inward and release them from the catches. Elastomeric member 130 is also sufficiently flexible to allow a user to pull male connector 110 apart from female connector 120, as shown in FIG. 2. Elastomeric member 130 advantageously holds connector 110 and connector 120 together in close proximity while they are disengaged to facilitate their re-engagement at a later time. In other words, the size, dimension, and elasticity (or tension) of elastomeric member 130 is selected to allow connector 110 and 120 to remain in a disengaged state even when there is no separation force (e.g. when the user is not pulling the connectors apart). However, in yet another embodiment, it is contemplated that elastomeric member 130 can be configured to provide sufficient tension such that, when the user releases connectors 110 and 120 from separation, the prongs of connector 110 re-engage the catches of connector 120. In both embodiments, the elastomeric member 130 allows a user to temporarily separate connectors 110 and 120 within a limited separation distance that is defined by the elasticity of elastomeric member 130, and provide an auto-return of the connectors 110 and 120 to close proximity.

As used herein, "engaged" means the latching features of the connectors are mated to provide a rigid connection. Likewise, "disengaged" means the latching features of the connectors are decoupled (e.g., not rigidly connected), although the connectors may still be in close proximity and/or contact. As used herein, auto-return means the tension of the elastomeric member is sufficient to bring the connectors, straps, and/or strap ends in close proximity when there is no separation force. The separation force can be a user pulling the connectors apart, or the weight of an object causing the straps to separate. As used herein, "auto-engage" means the tension of the elastomeric member is sufficient to cause the latching features of the connectors to re-engage.

Elastomeric member 130 is shown as a sleeve configuration in FIGS. 1 and 2. The sleeve has a length, an interior space, and openings on each end of the sleeve for accessing the interior space. Connectors 110 and 120 are disposed inside the interior space. Connectors 110 and 120 can be rigidly and fixedly attached to elastomeric member 130 or, alternatively, can be allowed to slide inside the interior space. Connectors 110 and 120 can also be removably coupled with elastomeric member 130. This allows connectors 110 and 120 to be totally separated from one another. When connectors 110 and 120 are on different ends of the same strap, removing elastomeric member 130 from connectors 110 and 120 will allow the strap to be fastened around an object.

In addition to sleeve configurations, it is also contemplated that elastomeric member 130 can comprise a strap, bridge, or any other structure suitable for holding connector 110 and connector 120 in close proximity when in the disengaged state. As used herein, to hold elements in "close proximity" means to limit their maximum separation distance. For some applications, the maximum separation distance can be limited to 12 inches or less, more preferably 6 inches or less, and most preferably 1 inch or less. In yet other applications, it is contemplated that the maximum separation distance could be much greater.

By keeping connectors 110 and 120 in close proximity, elastomeric member 130 helps to align the prongs of connector 110 with the opening of connector 120 for re-engagement. It is contemplated that the elasticity or tension provided by elastomeric member 130 can be adjusted. For example, elastomeric member 130 could comprise a set of 5 different sizes of elastic bands that can be interchangeably used with connectors 110 and 120 to provide 5 or more different degrees of tension. Elastomeric member 130 could also comprise an elastic band that has an adjustable length (or circumference). In yet other embodiments, elastomeric member 130 could comprise an elastic material that stiffens or loosens when exposed to different temperatures, voltages, or vibrations. The ability to adjust the elasticity of elastomeric member 130 advantageously allows for compatibility with many different objects having different sizes, dimensions, surface hardnesses, and/or weights. In some embodiments, elastomeric member 130 is made of different materials having different degrees of rigidity and flexibility to provide adjustability of tension and/or to encourage stretching in a specific direction.

The elasticity of member 130 can be configured (e.g., more stiff, more loose) depending on the application. For example, it is contemplated that fastener 100 can be incorporated into shoulder straps of a backpack to allow the wearer to expand the size of the arm strap loop without the need for adjusting the strap's sliding buckle. In such embodiments, member 130 may have a minimal elasticity to prevent a heavy load from separating connector 110 and connector 120 too much when in the disengaged configuration. In this manner, fastener 100 provides greater ease of use and precision compared to conventional backpack fasteners and buckles because the wearer can set the strap length to a desired length (typically by adjusting a sliding buckle) and then use fastener 100 to limit the maximum separation distance between the arm strap connectors for putting on the backpack. From a methods perspective, the user can "loosen" the arm straps by disengaging the connectors and allow elastomeric member 130 to stretch. Connectors 110 and 120 can then be separated by a maximum distance defined by the elasticity of elastomeric member 130. Once the straps are around the user's shoulders, the user can easily re-engage connectors 110 and 120 since the elastomeric member 130 is biased to keep them in close proximity.

Other contemplated applications include shoes, boots, gloves, belts, hats, baseball caps, and other wearable items that require donning the item. Fastener 100 allows the user to temporarily expand the size of a loop to facilitate donning or fastening an object, while providing an auto-return of connectors 110 and connector 120 for re-engagement. When fastener 100 is incorporated on a belt, it is further contemplated that the belt could include a second buckle or releasable attachment point so that the belt can be fed into pant belt loops without the need for disengagement of fastener 100.

In yet other embodiments, it is contemplated that the catches of female connector 120 may be eliminated such that connector 110 and connector 120 are only held together via elastomeric member 130. In yet other embodiments, connector 110 and connector 120 can comprise a magnetic coupling.

It is contemplated that connectors 110 and 120 can be manufactured by various methods, such as machining, thermoforming, additive manufacturing (3D printing), extruding, injection molding, and any other process suitable for achieving the structure and function described herein.

Figure 3:
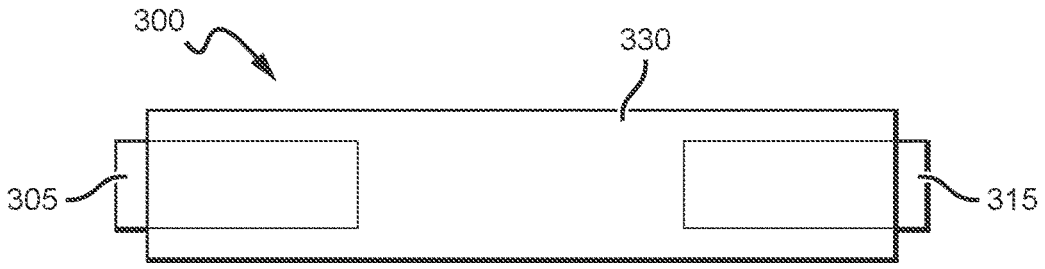
FIG. 3 is a front view of another embodiment of a stretch fastener comprising two strap ends connected by an elastomeric member.

FIG. 3 shows another embodiment of a fastener 300 comprising two straps 305 and 315 joined by an elastomeric member 330. Straps 305 and 315 comprise a narrow strip of pliant material having a length that is sized and dimensioned to wrap around an object. In other embodiments, straps 305 and 315 could comprise a rigid plastic material, leather, thin flat metal, a plastic or fabric band, or any other structure suitable for fastening, clamping, and/or securing an object's position. The elastomeric member is a sleeve having a length, a first end attached to strap 305 and a second end attached to strap 315. The attachment can be rigid and fixed. It is also contemplated that the attachment could allow for the strap ends to slide within an interior space of the sleeve. In yet other embodiments, elastomeric member 330 could comprise configurations other than a sleeve, such as a strap, string, or other stretchable structure suitable for providing a bridge between the two strap ends. The elastomeric member can have an adjustable elasticity to provide different degrees of tension depending on the application and loads that the fastener will experience during use.

Figure 4:
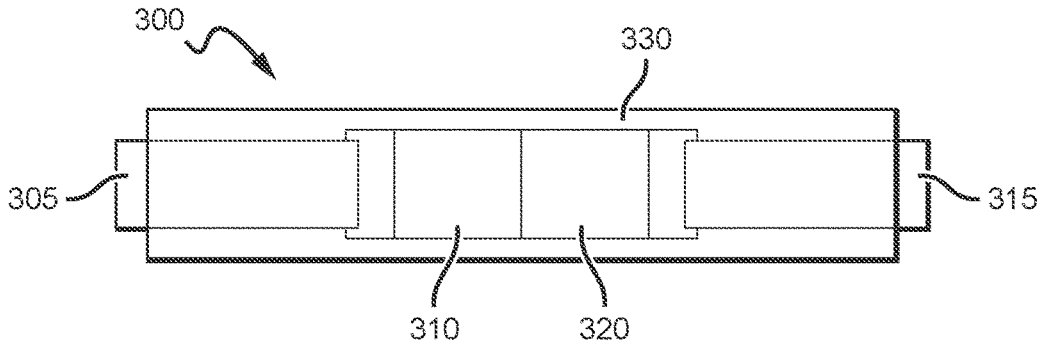
FIG. 4 is a front view of the fastener of FIG. 3 with connectors attached to the two strap ends and in an engaged configuration.

FIG. 4 shows fastener 300 of FIG. 3 with two engaging connectors 310 and 320 attached to the two strap ends. In this embodiment, the elastomeric member is still coupled with the strap ends 305 and 315, however strap end 305 is attached to connector 310 and strap end 315 is attached to connector 320. Connectors 310 and 320 are configured to releasably engage with one another. When engaged, they provide a rigid connection to hold strap ends 305 and 315 together. When disengaged, strap ends 305 and 315 are loosely coupled together via elastomeric member 330 and can be stretched apart. Connectors 310 and 320 can be rigidly affixed to elastomeric member 330 to prevent their relative movement. In yet other embodiments, connectors 310 and 320 are allowed to slide within the interior space of the sleeve.

Figure 5A:
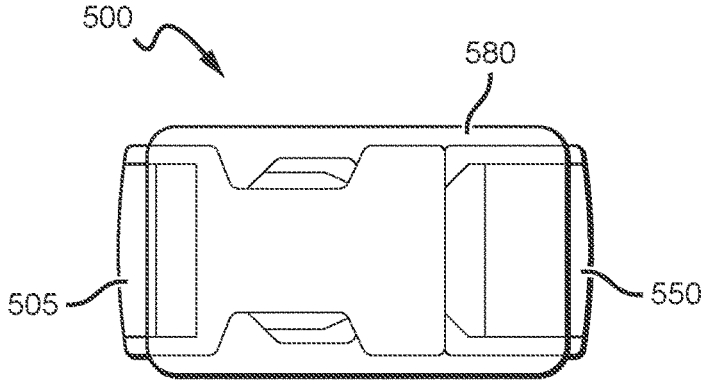
FIG. 5*a* is a front view of another embodiment of a stretch fastener in an engaged configuration.

FIG. 5*a* shows a female connector 505 that is releasably coupled with a male connector 550 within an elastomeric member 580 (shown with transparency for illustrative purposes).

Figure 5B:
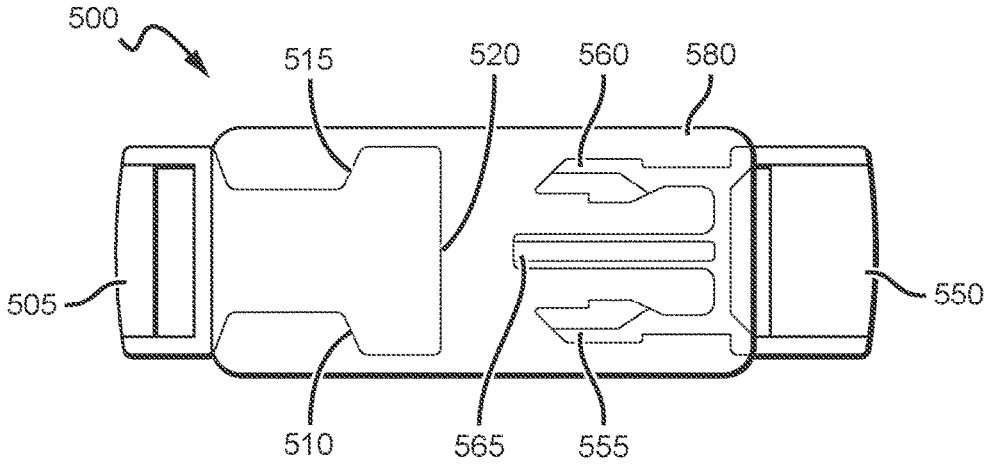
FIG. 5*b* is a front view of the fastener of FIG. 5*a* in a disengaged configuration and showing an alignment post.

FIG. 5*b* shows connector 505 and 550 in a disengaged configuration with elastomeric member 580 in a stretched state.

Figure 5C:
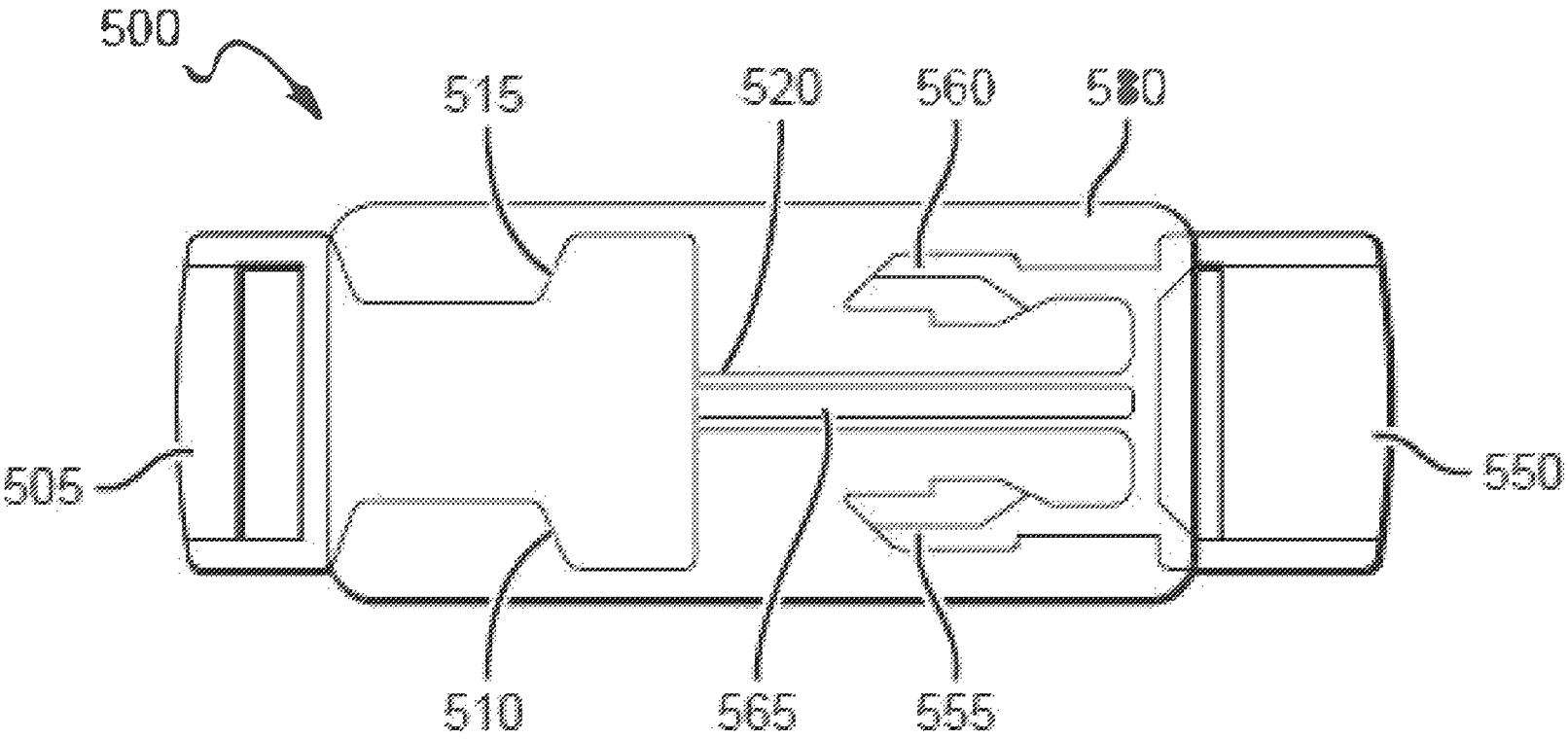
FIG. 5*c* is a front view of an alternative embodiment of the fastener of FIG. 5*a* in a disengaged configuration and showing a longer alignment post.

Female connector 505 has latches 510 and 515, and a channel 520. Male connector 550 has flexible prongs 555 and 560 that are configured to catch on latches 510 and 520 when male connector 550 is inserted into female connector 505. Prongs 555 and 560 have sufficient rigidity to remain latched onto latches 510 and 515 during use, yet have sufficient flexibility to allow a user to press the prongs 555 and 560 inward to unlatch. Male connector 550 also has an alignment post 565 that is sized and dimensioned to slide within channel 520 to facilitate insertion. In the disengaged state, as shown in FIG. 5*b*, prongs 555 and 560 are unlatched from catches 510 and 515 and alignment post 565 is separated from channel 520. Elastomeric member 580 provides a tension that limits the maximum separation distance between connectors 505 and 550. FIG. 5*c* shows an alternative embodiment in which alignment post 565 is substantially longer than alignment post 565 in FIG. 5*b*, such that it remains in contact with channel 520 even after prongs 555 and 560 are unlatched from catches 510 and 515. It is also contemplated that the length of alignment post 565 can be long enough to maintain alignment of connectors 505 and 550 when further separated by stretching elastomeric member 580. From a methods perspective, a person using fastener 500 could temporarily disengage connectors 505 and 550, stretch elastomeric member 580 to wrap around an object, and re-engage connectors 505 and 550 quickly due to the pre-alignment. In yet other embodiments, it is further contemplated that the alignment post 565 could be a curved or irregular rather than linear to provide pre-alignment even when connectors 505 and 550 are out of plane or angled relative to one another during disengagement.

Figure 6A:
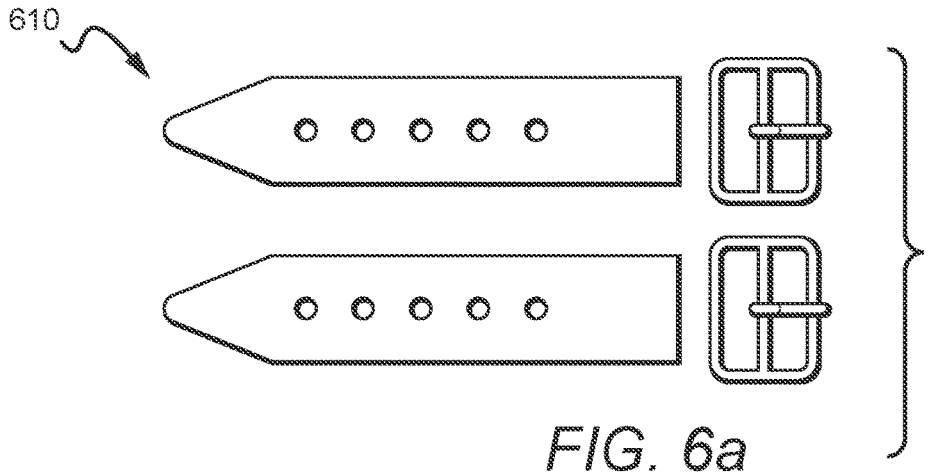
FIG. 6*a* shows a strap-buckle fastener.
Figure 6B:
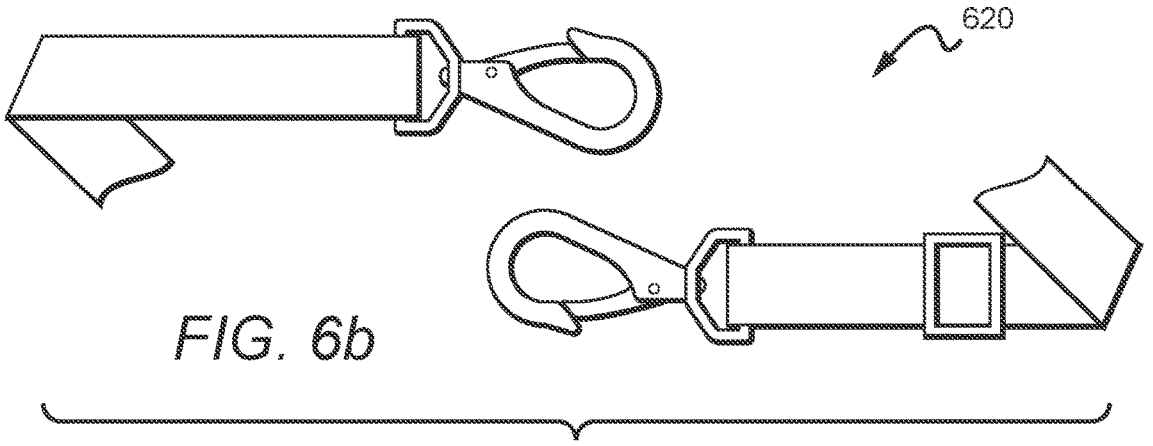
FIG. 6*b* shows a latching hook fastener.
Figure 6C:
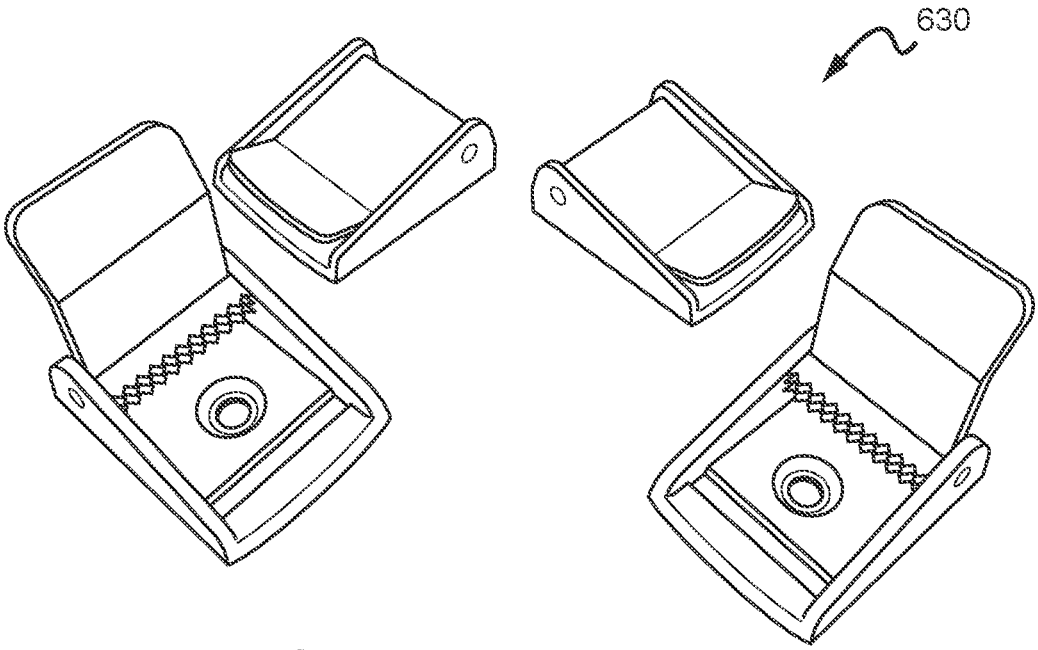
FIG. 6*c* shows a strap and pinch buckle fastener.
Figure 6D:
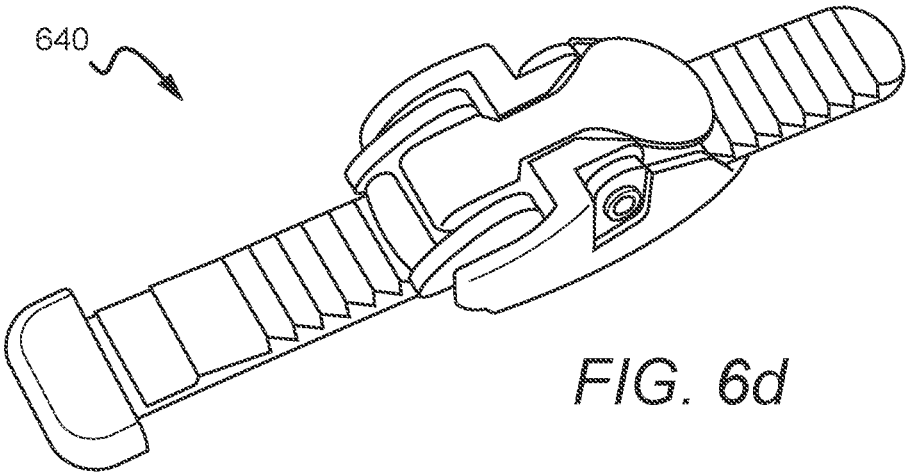
FIG. 6*d* shows a grooved strap and ratcheting fastener.

FIGS. 6*a-d* shows different types of connectors that could be used with the present inventive subject matter. FIG. 6*a* shows a strap-buckle fastener 610. FIG. 6*b* shows a latching hook fastener 620. FIG. 6*c* shows a strap and pinch buckle fastener 630. FIG. 6*d* shows a grooved strap and ratcheting fastener 640. All of these fasteners can be used in combination with an elastomeric member to keep the two ends of the fastener loosely together when the connectors are disengaged.

Figure 7:
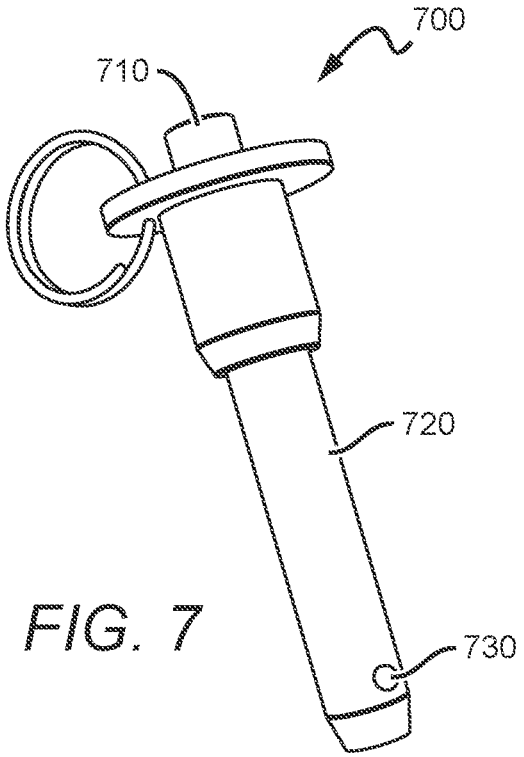
FIG. 7 shows a spring-loaded pin connector.

In yet other configurations, one or more spring-loaded pins could be incorporated into the fastener and/or connectors, and could be used to bias the connectors apart from one another. FIG. 7 shows an example of a spring loaded connector pin 700 that has a button 710, elongated member 720 and a spring-biased detent 730. Detent 730 is biased outward by a spring and can be push/retracted into elongated member 720 to de-latch from a female connector. Connector pin 700 can be used as a connector system in combination with the elastomeric members described herein, in addition to male female latching connectors. It is also contemplated that latching pins using canted coil springs can be used as a connector in combination with an elastomeric member. It is further contemplated that magnets (and/or magnetically attractable elements) can be used as connectors in combination with an elastomeric member.

Figure 8B:
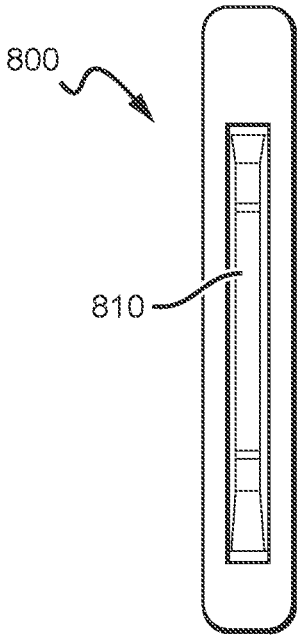
FIG. 8*b* shows a front plan view of the elastomeric member of FIG. 8*a*.
Figure 8A:
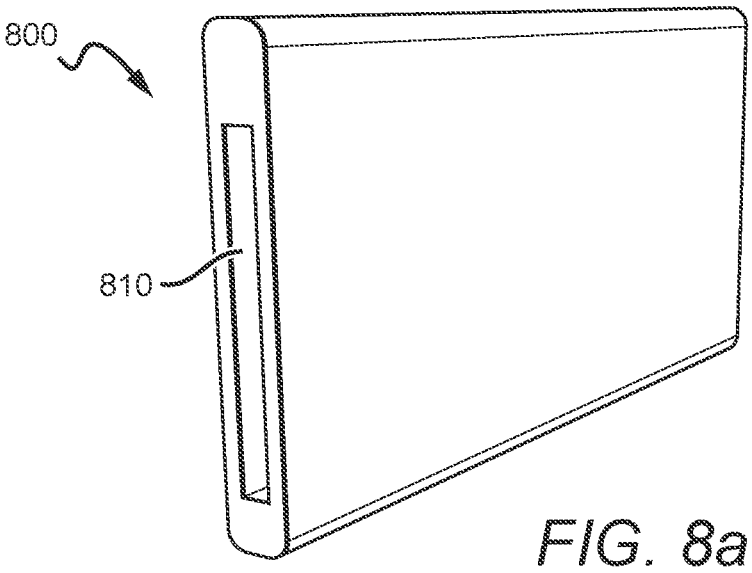
FIG. 8*a* shows a top front perspective view of an elastomeric member.

FIG. 8*a* shows a perspective view of an elastomeric member 800 apart from any straps or connectors. Elastomeric member 800 is made of an elastic material that allows member 800 to stretch along its length. Elastomeric member 800 has an opening 810 that defines an interior space within elastomeric member 800. In this configuration, elastomeric member 800 is a sleeve. Opening 810 can be narrower than the interior space so that a connector or strap component inside the interior space is too big to exit opening 810. FIG. 8*b* shows a side view of opening 810 and provides a better view to the size of the interior space compared to opening 810. Straps and connectors can be slidably disposed within the interior space as shown in FIGS. 1-5.

Figure 9:
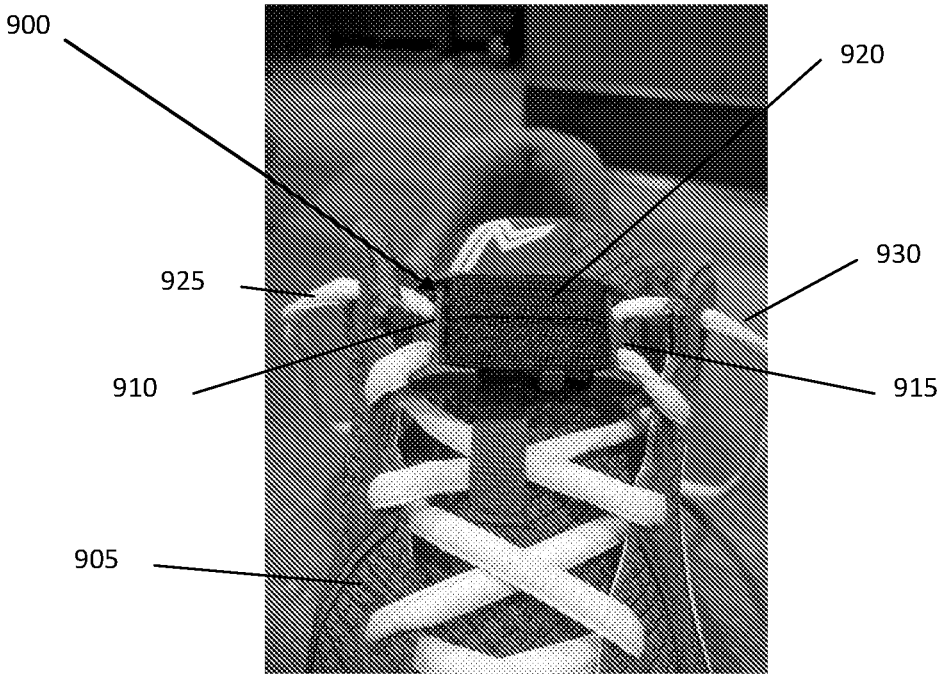
FIG. 9 shows a front top perspective view of a shoe with a stretch fastener.

FIG. 9 shows a fastener 900 on a shoe 905. Fastener 900 comprises a male connector 910 and a female connector 915 coupled together by an elastomeric member 920. Elastomeric member 920 is an elastic strap that limits the maximum separation distances between connectors 910 and 915. Shoe laces 925 and 930 are attached to connectors 910 and 915, respectively. When connectors 910 and 915 are disengaged, elastomeric member 920 can stretch as a user dons the shoe. Once the shoe is on, the user can engage connectors 910 and 915 to provide a rigid attachment. In this embodiment, shoe 905 can be worn in a "loose" state (e.g., connectors 910 and 915 are disengaged) for lighter activities (e.g., walking), and in a "tight" state (e.g., connectors 910 and 915 are engaged) for more strenuous activities (e.g., running, climbing, aerobics). The user may also chose to adjust the tension of shoe laces 925 and 930, and the tension of elastomeric member 920 to provide the desired fit. For example, the user could adjust the length of elastomeric member 920 to provide the desired level of tension.

Figure 10A:
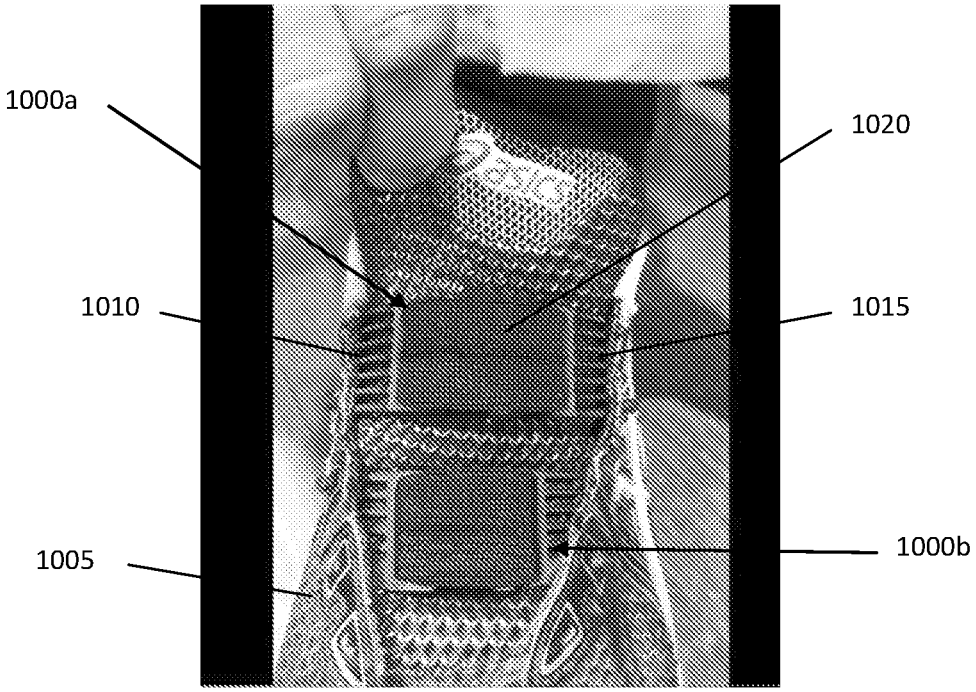
FIG. 10*a* shows a front top perspective view of a shoe that has two stretch fasteners, the top one in an engaged position and the bottom one in a disengaged position.
Figure 10B:
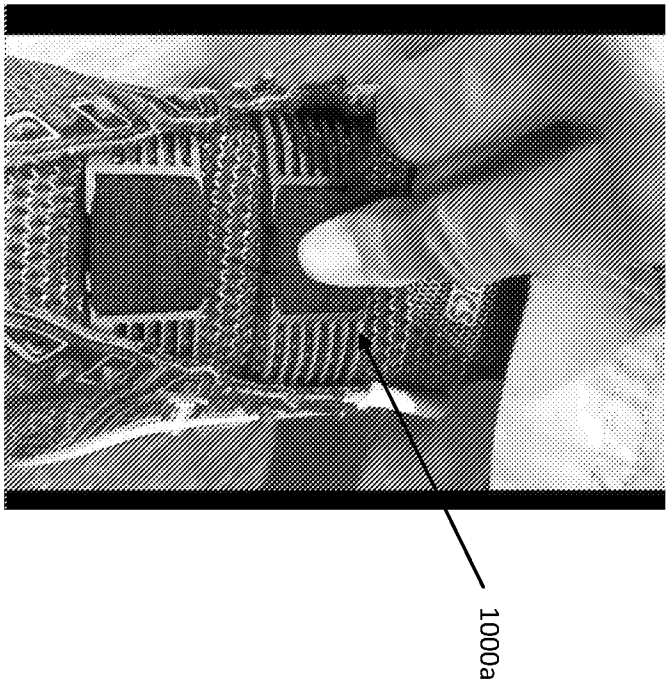
FIG. 10*b* shows a front top perspective view of the shoe of FIG. 10*a* with both fasteners in an engaged position.

FIG. 10*a* shows a shoe 1005 that has fasteners 1000*a* and 1000*b*. Fasteners 1000*a* and 1000*b* are identical, however in this view fastener 1000*a* is disengaged and fastener 1000*b* is engaged. Fasteners 1000*a* and 1000*b* each comprise two connectors 1010 and 1015 coupled by an elastomeric member 1020. Connectors 1010 and 1015 are made of a rigid plastic and have a curved length. Each connector has (i) a first end with prongs that attach to shoe lace holes in shoe 1005, and (ii) a second end comprising a male or female connector. When connectors 1010 and 1015 are dis-engaged from one another, elastomeric member 1020 can stretch to facilitate donning the shoe. Once the user's foot is inside shoe 1005, the user can push down on fastener 1000*a* to engage connectors 1010 and 1015, as shown in FIG. 10*b*.

It should be apparent to those skilled in the art that many more modifications besides those already described are possible without departing from the inventive concepts herein. The inventive subject matter, therefore, is not to be restricted except in the scope of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A fastener comprising:

a first connector having a first end and a second end;

a second connector having a first end and a second end;

wherein the first end of the first connector engages and disengages with the first end of the second connector;

an elastomeric member attached to and extending between the first end of the first connector and the first end of the second connector to provide a force that holds the first connector and second connector together and limits a separation distance between the first end of the first connector and first end of the second connector; and a first strap end attached to the second end of the first connector; and a second strap end attached to the second end of the second connector.

2. The fastener of claim 1, wherein the elasticity of the elastomeric member is adjustable.

3. The fastener of claim 2, wherein the adjustable elastomeric member comprises at least one of an adjustable strap, a magnetorheological fluid, an electrorheological fluid, electroactive polymer or similar reactive material and a plurality of attachment points for coupling the elastomeric member to each of the first strap end and second strap end.

4. The fastener of claim 1, wherein the elastomeric member removably couples with the first strap end and the second strap end.

5. The fastener of claim 1, wherein the elastomeric member removably couples with the first connector and the second connector.

6. The fastener of claim 1, wherein the elastomeric member provides a tension that brings the first strap end in close proximity to the second strap end.

7. The fastener of claim 1, wherein the elastomeric member has sufficient elasticity to allow for a separation distance of at least 1 inch between the first strap end and the second strap end.

8. The fastener of claim 1, wherein the elastomeric member has sufficient elasticity such that the first strap end and the second strap end can be separated by a distance of at least 1 inch with no more than 10 pounds of force.

9. The fastener of claim 1, wherein the elastomeric member comprises a sleeve.

10. The fastener of claim 1, further comprising an elastomeric material that couples with the elastomeric member to increase elasticity.

11. A fastener comprising:

a first connector attached to a first strap;

a second connector attached to a second strap;

an elastomeric member attached to the first connector and second connector; and wherein the elastomeric member provides a force that holds the first connector and second connector together and limits a separation distance between the first connector and second connector.

12. The fastener of claim 11, wherein the elastomeric member comprises a plurality of attachment points that removably couple with at least one of the first connector and the first strap.

13. The fastener of claim 12, wherein the elastomeric member comprises a plurality of attachment points that removably couple with at least one of the second connector and the second strap.

14. The fastener of claim 11, wherein the first connector and second connector magnetically couple together.

15. The fastener of claim 11, wherein the elastomeric member has sufficient elasticity to bring the first and second connectors in close proximity.

16. The fastener of claim 11, wherein the elastomeric member has sufficient elasticity to engage the first and second connectors.

17. A fastener comprising:

a first connector;

a second connector that slidably engages and disengages with the first connector along a path of engagement;

an elastomeric member attached to the first connector and the second connector along the path of engagement;

wherein the elastomeric member has sufficient elasticity to allow the first connector and the second connector to separate by a first distance when a separation force is applied; and wherein the elastomeric member holds the first connector and second connector together and in alignment for re-engagement.

18. The fastener of claim 17, wherein the first connector comprises an alignment post that slidably engages a channel of the second connector and is sized and dimensioned to maintain the first connector in alignment with the second connector when separated by the first distance.

* * * * *